United States Patent [19]

Focke

[11] Patent Number: 5,024,376

[45] Date of Patent: Jun. 18, 1991

[54] WEB OF MATERIAL CONSISTING OF (PACK) BLANKS CONNECTED TO ONE ANOTHER

[75] Inventor: Heinz Focke, Verden, Fed. Rep. of Germany

[73] Assignee: Focke & Co., GmbH, Fed. Rep. of Germany

[21] Appl. No.: 527,604

[22] Filed: May 23, 1990

[30] Foreign Application Priority Data

May 23, 1989 [DE] Fed. Rep. of Germany ..... 3916756

[51] Int. Cl.[5] ..... B65D 5/66

[52] U.S. Cl. ..... 229/160.1; 206/273

[58] Field of Search ..... 229/160.1; 206/268, 206/271, 273

[56] References Cited

U.S. PATENT DOCUMENTS 4,193,534 3/1980 Focke et al. ..... 206/268
4,251,022 2/1981 Focke ..... 206/268
4,753,384 6/1988 Focke et al. ..... 206/273

FOREIGN PATENT DOCUMENTS 3713612 11/1988 Fed. Rep. of Germany .
WO79/00034 1/1979 PCT Int'l Appl. .

*Primary Examiner*—Gary E. Elkins
*Attorney, Agent, or Firm*—Sughrue, Mion, Zinn Macpeak & Seas

[57] ABSTRACT

Web of material consisting of blanks connected to one another by means of residual webs and intended for hinge-lid packs. So that blanks consisting of thin cardboard can be processed as material in web form by a packaging machine, the blanks are connected to one another in the web of material at their free edges by residual webs which are severed in the region of the packaging machine in order to provide the individual blanks necessary for the packaging process. For blanks (14) which are provided with an integrally attached collar blank portion (32) in the region of a pack front wall portion (15) of each blank (14), the web of material (37) is designed so that adjacent blanks are also connected to one another in the region of the collar blank portion (32) by at least one residual web (40), specifically at the free edges of collar side walls (34). Furthermore, residual connecting webs (38, 39) are provided in the web of material in the region of inner side-wall tabs (21) and in the region of inner lid side tabs (29).

5 Claims, 2 Drawing Sheets

WEB OF MATERIAL CONSISTING OF (PACK) BLANKS CONNECTED TO ONE ANOTHER

BACKGROUND OF THE INVENTION

The invention relates to a web of material consisting of blanks arranged in series and connected to one another at free edges by means of residual webs, for the production of hinge-lid packs, the blanks consisting of a pack blank and of a collar blank connected integrally to the latter and having collar side tabs.

Hinge-lid packs made of thin cardboard are, in practice, produced predominantly from individual blanks prefabricated at the factory. EP-A-291,692 explains a proposal in which the blanks consisting of thin cardboard are connected to one another at longitudinal edges so that they can be separated, for example torn off. For this purpose, selected portions of the free edges of lateral blank parts are connected to one another via residual connections or residual webs. Residual webs guarantee that the blanks are held together within the web of material. The blanks can therefore be stored, transported and used at the processing point as a continuous web of material, especially as a wound reel. Within the packaging machine, individual blanks are produced by separating from the web of material and are processed in the conventional way.

In the abovementioned known proposal, residual webs for connecting blanks to one another are arranged at those locations which, in the finished pack (hinge-lid pack), are arranged on the inside or in a concealed manner. Small remains of the severed residual webs therefore remain invisible. In actual fact, these residual webs are arranged in the region of inner side tabs and likewise inner lid side tabs of the pack.

SUMMARY OF THE INVENTION

The invention is concerned with transferring the above-described idea of connecting blanks for hinge-lid packs to one another to form continuous webs of material to a special design of a hinge-lid pack, in particular with a collar blank connected integrally to the blank or pack blank. Hinge-lid packs are conventionally equipped with a collar which is arranged in a pack part of the hinge-lid pack, projects from this and is surrounded by the lid when the hinge-lid pack is in the closed position. According to EP-A-6,872, a hinge-lid pack of this type with a collar can be produced from a one-piece blank. In this version, a collar blank is connected to a pack blank via connecting webs. The connecting webs, which can also extend over the entire width of a front wall of the hinge-lid pack, are folded in a Z-shaped manner, in order to bring the collar into the relative position suitable for the pack. In the exemplary embodiment of EP-A-6,872, the collar blank and pack blank are connected by means of residual connections to form a one-piece blank.

The object on which the invention is based is to design blanks for hinge-lid packs with an integrally attached collar blank in such a way that they can form a coherent continuous web of material and can be separated from the latter as a unit.

To achieve this object, the web of material according to the invention is characterized in that adjacent blanks are connected to one another (also) in the region of the collar blank by means of at least one residual web at the free mutually confronting edges of collar side tabs.

The invention is based on the knowledge that, as regards complex blanks, such as those blanks for the production of hinge-lid packs, in which the collar blank is connected integrally to the pack blank, the residual webs as holding members between adjacent blanks within the web of material must be distributed and arranged in such a way that all the lateral tabs of the blanks within the web of material are held sufficiently firmly. The web of material must guarantee a sufficiently durable connection between the blanks to guarantee transport, storage and processing within the packaging machine. On the other hand, it should become possible by simple means to separate the individual blanks from the web of material in a non-destructive manner.

According to a further feature of the invention, a single residual web connecting the collar side tabs of adjacent blanks to one another is arranged at a distance from the free lateral edge of the web of material, particularly adjacent to the outer side tabs of the blank. This guarantees the best possible connection of the blanks within the web of material and, moreover, that the collar side tabs unstable because of their size, are fixed to the edge of the web of material.

Further features of the invention relate to the arrangement and appropriate distribution of residual webs for connecting the blanks within the web of material.

An exemplary embodiment of the invention is explained in detail below by means of the drawings. In these:

DETAILED DESCRIPTION OF A PREFERRED EMBODIMENT

Figure 1:
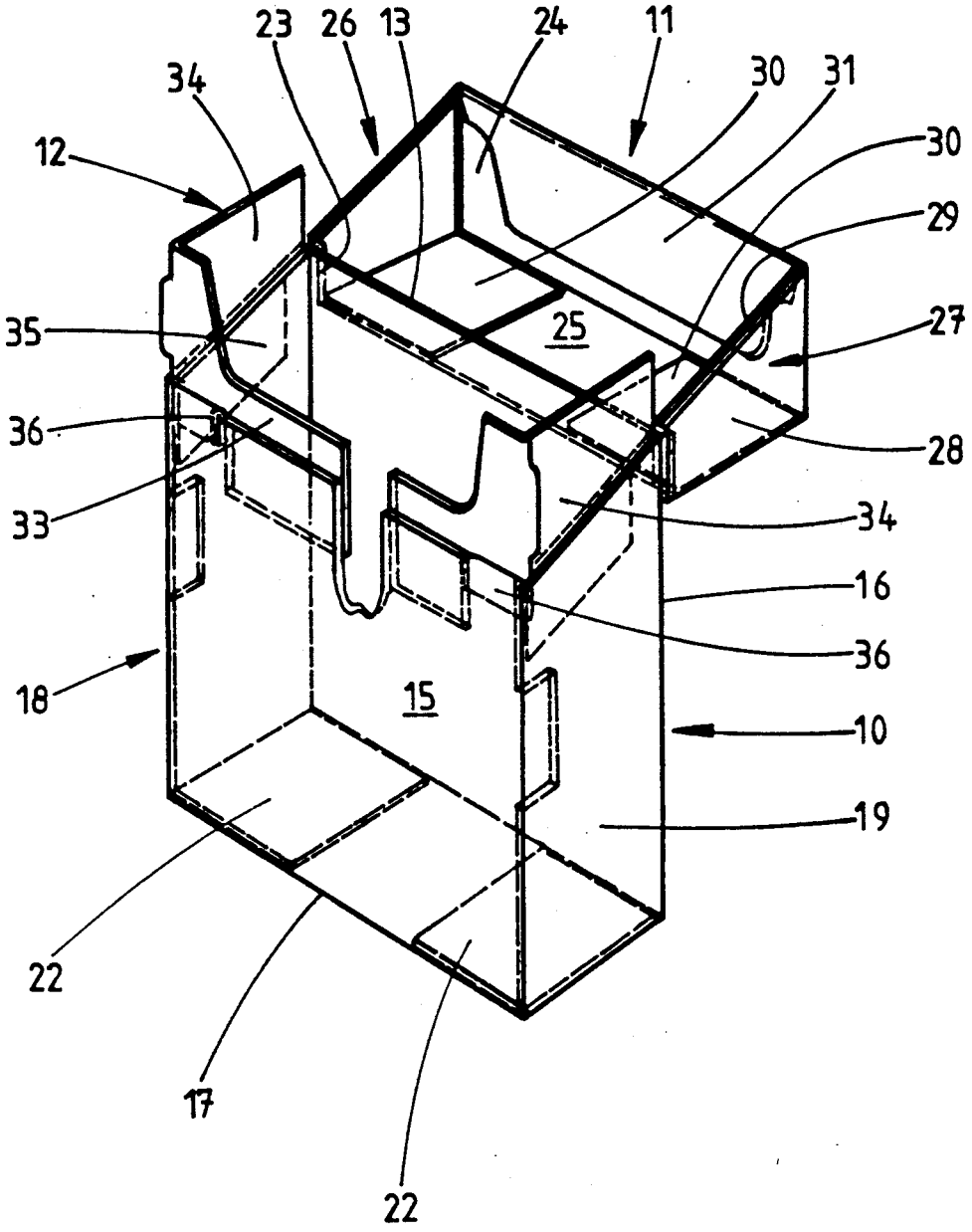
FIG. 1 shows a perspective representation of an opened hinge-lid pack.

FIG. 1 shows in perspective a hinge-lid pack which is intended, above all, for receiving cigarettes. As regards the basic design, the hinge-lid pack consists of a pack part 10, a lid 11 and a collar 12. The lid 11 is connected to the pack part 10 tiltably via a joint line 13. The collar 12 is arranged within the pack part 10 in such a way that the predominant region of the collar 12 projects from the pack part 10. When the hinge-lid pack is closed, the projecting part of the collar 12 is surrounded by the lid 11.

A blank 14 for producing a hinge-lid pack according to FIG. 1 consists of surface regions for forming a front wall 15, a rear wall 16 and a bottom wall 17. Side walls 18 and 19 consist of outer side-wall tabs 20 connected to the front wall 15 on the two longitudinal sides and of inner side-walls tabs 21 arranged in a corresponding way on the rear wall 16. In the present exemplary embodiment, the width of the side-wall tabs 20, 21 is calculated so that they overlap over approximately the entire width to form the side walls 18, 19. The side-wall tabs 20, 21 are connected to one another by adhesive bonding.

Arranged respectively in the extension of the side-wall tabs 20, 21 are bottom corner tabs 22 which are connected to the lower edges of the inner side-wall tabs 21 and which, in the finished hinge-lid pack, are folded against the inner face of the bottom wall 17.

The abovementioned blank parts constitute the pack part 10. The lid 11 consists of a lid rear wall 23, lid front wall 24 and lid top wall 25. Lid side walls 26 and 27 are formed by mutually overlapping outer lid side tabs 28 connected to one another by adhesive bonding and attached laterally to the lid front wall 24, and by inner lid side tabs 29. The latter are attached laterally to the lid rear wall. Located on the inner lid side tabs 29 in a similar way to the bottom corner tabs are lid corner tabs 30 which are folded against the inner face of the lid 11 or of the lid top wall 25. Located on the free edge of the lid front wall is an inner tab 31 which is folded for reinforcement against the inner face of the lid front wall 24.

Connected integrally to the blank thus formed is a collar blank 32. This consists of a collar front wall 33 and collar side walls 34. In the spread-out position, the collar blank 32 directly adjoins the blank 14, specifically in the extension of the front wall 15 and of the side-wall tabs 20. The entire blank 14 therefore has an approximately rectangular shape, with the exception of the inner tab 31 on one side and a central recess 35 on the other side, particularly in the region of the collar blank 32.

In the present exemplary embodiment, the collar blank 32 is connected to the upper edge of the front wall 15 only via strip-shaped residual connections 36 at the sides of the collar front wall 33. The residual connections 36 are folded in a Z-shaped manner, in order to bring the collar blank 32 or the collar 12 formed therefrom into the relative position suitable for the pack.

Figure 2:
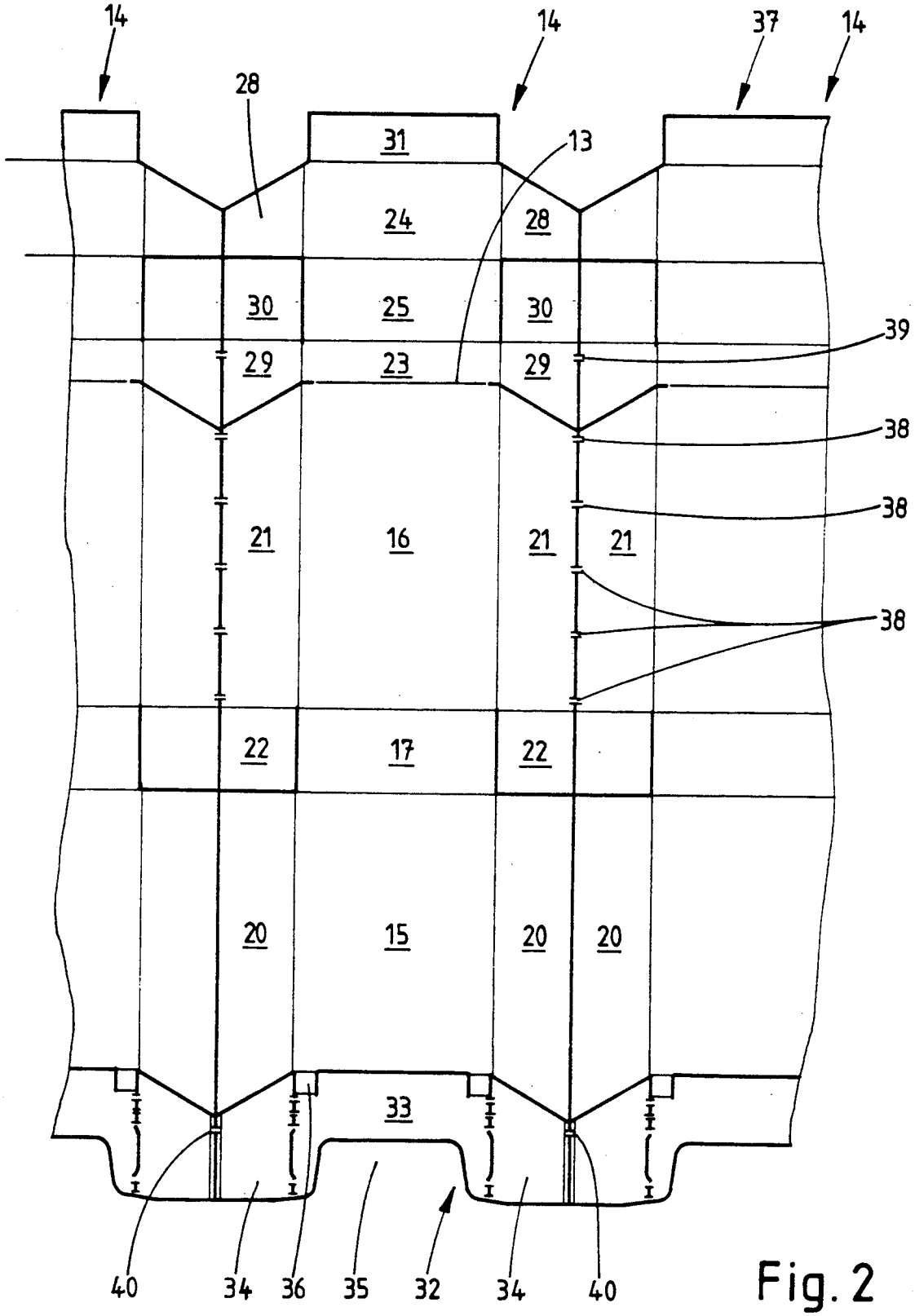
FIG. 2 shows a cutout from a web of material with blanks for the production of packs according to FIG. 1.

According to FIG. 2, the blanks 14 consisting of thin cardboard are connected to one another to form a web of material 37. The blanks 14 are arranged with their longitudinal extension directed transversely within the web of material. To provide a continuous web of material 37, free edges of the blanks 14 are connected to one another so that they can be separated or torn off, specifically by means of residual webs 38, 39, 40. These are arranged in a special way, in particular are distributed over the length of the blank 14, with the best possible selection of the blank parts to be connected to one another.

In the exemplary embodiment illustrated, the adjacent inner side-wall tabs 21 are connected to one another by means of residual webs 38, specifically by means of a total of five such residual webs 38. These are arranged at equal distances from one another, a residual web 38 being arranged at each of the ends of the elongated side-wall tabs 21. Projections remaining on the edges of the side-wall tabs 21 when the residual webs 38 are severed cannot be seen in the finished hinge-lid pack because they are located on its inside.

Furthermore, adjacent inner lid side tabs 29 are connected to one another, specifically, in the present case, by means of a single residual web 39. This is arranged at a distance from the side-wall tabs 21, particularly at a short distance from the upper limitation of the lid side tab 29.

Finally, the collar blanks 32 of adjacent blanks 14 are connected to one another in the region of the collar side walls 34. Here too, only one residual web 40 is provided. This is arranged at a clear distance from the free upper edge of the collar side wall 34, in particular adjacent to the outer side-wall tab 20. As a result of the relative shift of the collar blank 32 in relation to the pack part 10, a projection obtained when the residual web 40 is severed comes into the region of the side-wall tab 20 and is therefore concealed by the side walls 18, 19.

The connection of the blanks 14 to one another in the abovementioned way has proved optimal for a sufficient retention of the web of material 37 before the formation of the individual blanks 14. On the other hand, an efficient separation of the blanks 14 is possible without destroying them. The residual webs 38, 39, 40 preferably have a width of 0.5 mm.

What is claimed is:

1. Web of material consisting of individual blanks (14) for the production of finished hinge-lid packs of the type having an internal collar, wherein each of the individual blanks (14) consists of a pack blank portion and of a collar blank portion (32) which is integrally connected to the pack blank portion and which has collar side walls (34);

wherein said blanks are arranged in series, and adjacent pack blank portions are connected to one another only at selected free blank edges by primary residual connecting webs (38) in the web of material;

wherein adjacent individual blanks (14) are also connected to one another in a region of the collar blank portion (32) by at least one collar residual connecting web (40) between free mutually confronting edges of adjacent collar side walls (34); and wherein adjacent blank edges are free and disconnected from one another in said web of material except for said primary and collar residual connecting webs.

2. Web of material according to claim 1, wherein in a region of side-wall tabs (21) located on the inside in a finished hinge-lid pack, the adjacent individual blanks (14) are connected to one another, to form finished pack side walls (18, 19), only by five side-wall residual connecting webs (38) spaced apart at a uniform distance from one another.

3. Web of material according to claim 2, wherein, in a region of lid side tabs (29) located on the inside in the finished hinge-lid pack, the adjacent individual blanks (14) are connected to one another, to form lid side walls (26, 27), only by a lid residual web (39) which is located on that side of each lid side tab (29) confronting a lid corner tab (30) of the blank (14) and which is spaced from an adjacent one of said five residual connected webs (38) of the side wall tabs (21) by a distance which corresponds approximately to the uniform distance between said five residual connecting webs (38) in the region of the side-wall tabs (21).

4. Web of material according to claim 3, wherein there is only a collar residual connecting web (40) connecting said adjacent collar side walls (34) said single collar residual connecting web (40) being located at a relatively large distance from a free upper edge of each collar side wall (34) and directly adjacent to an outer side-wall tab (20) of the blank (14).

5. Web of material according to claim 4, wherein the side-wall, collar and lid residual connecting webs (38, 39, 40) have a width of approximately 0.5 mm.

* * * * *